United States Patent [19]

Giraud

[11] 4,095,087

[45] June 13, 1978

[54] MINIATURE SYSTEM FOR CENTRAL HEATING AND WATER HEATING

[76] Inventor: Gabriel Giraud, 191, rue du Commandant Roland, 13008 Marseilles, France

[21] Appl. No.: 636,361

[22] Filed: Dec. 1, 1975

[30] Foreign Application Priority Data

Dec. 2, 1974 France ..... 74 40708

[51] Int. Cl.[2] ..... H05B 1/00; F24H 3/06; F24D 3/02; F24H 1/10

[52] U.S. Cl. ..... 219/298; 165/107; 219/306; 219/314; 219/341; 237/16

[58] Field of Search ..... 219/341, 321, 306, 298, 219/365, 314, 320, 296–299, 302–309, 381, 382; 165/107; 237/16–18; 126/101; 122/266, 267

[56] References Cited

U.S. PATENT DOCUMENTS

| | | | |
|---|---|---|---|
| 1,640,049 | 8/1927 | Nesmith | 219/298 X |
| 1,684,963 | 9/1928 | Luehrs | 219/306 X |
| 2,686,863 | 8/1954 | Chandler | 219/306 X |
| 2,700,505 | 1/1955 | Jackson | 219/341 UX |
| 2,825,791 | 3/1958 | Jackson | 219/321 X |
| 3,353,000 | 11/1967 | Tomlinson | 219/321 |
| 3,586,822 | 6/1971 | Pastore | 219/321 X |

*Primary Examiner*—A. Bartis

*Attorney, Agent, or Firm*—Robert E. Burns; Emmanuel J. Lobato; Bruce L. Adams

[57] ABSTRACT

A miniature heater system has electric immersion heaters in a heating enclosure which forms a compact monoblock composite unit resistant to high pressures. In this unit several horizontal tubes are connected at or near their ends by two vertical distributing tubes, one of which is upwardly extended by a circulating pump and the other by a water-mixing turbulator. The unit, with its control, regulating and safety devices is enclosed in a preferably metallic covering.

6 Claims, 5 Drawing Figures

38
BLOW-OFF
37
EXPANSION VESSEL
35
36
34
35
36
34
31
30
26
33
32
27
29
28
13
11
12
24
PRESSURE GAUGE 26
27
29
28
11
12
24
PRESSURE GAUGE
13

38
BLOW-OFF
37
EXPANSION VESSEL
39
40
31
30
26
27
32
33
28
29
11
12
13
24
PRESSURE GAUGE

MINIATURE SYSTEM FOR CENTRAL HEATING AND WATER HEATING

BACKGROUND OF THE INVENTION

The present invention relates to a miniature electrical and fluid-circulation furnace for collective or individual central heating and individual or collective water heating.

At the present time the installers locate the entire production of heat of a building or of a group of buildings in a single boiler room which is preferably underground where large boilers and combustion apparatus of high power feed the heating system and the water distribution system with hot water.

The large distance which is sometimes present between this central furnace and the heating radiators and points of use of hot water requires the installing of very long connecting and distributing pipes the cost of which for design, labor, and material in general is very high.

Furthermore, these installations require substantial structures of earthwork, building, and safety to be provided in the plans for the sheltering and operation thereof. This is true of the boiler room itself, of the flues and of the storage installations.

The inevitable length of the horizontal pipes connecting the heating units to the distribution risers results in an inevitable substantial loss of heat despite the heat insulation covering them, the quality and putting in place of which frequently leave a great deal to be desired.

In private houses all of these problems are present of course on a much smaller scale. The advantages of the invention are just as great.

SUMMARY OF THE INVENTION

The object of the present invention is to eliminate all of the aforementioned drawbacks. It offers a clean and powerful source of heat which contains in an extremely small amount of space the heating enclosure and all of its accessory members for central heating and water heating installations within the field of collective or individual equipment. It constitutes in itself a prefabricated manually transportable miniature furnace system.

Like any furnace system constructed in accordance with the requirements to be satisfied, the miniature furnace system may be adapted to different uses and to different powers.

Providing a compact monoblock unit of extremely small size and extra flat form, the miniature furnace system is in the form of a compact insulated body of parallelepiped shape requiring only functional connections for fluid and energy.

It has electrical immersion heating means characterized by the fact that the heating enclosure and certain of its appurtenances form a composite monoblock unit comprising a plurality of horizontal tubes connected at their ends by two vertical distributing tubes, and substantially defining by their specific technical form, the form of the enclosure, one of the vertical pipes extending to a circulation pump and the other similarly extending to a turbulator. The miniature furnace system furthermore has drive, control and safety means attached on the heating enclosure and including regulating members, all of these means and members being enclosed in a preferably metal covering, and the heating enclosure being heat insulated.

The installations are supplemented by risers to which there are attached the different heating surfaces or the hot water tanks. In existing installations the traditional installation in the boiler room is eliminated and the latter becomes free. Numerous other advantages will become evident upon use, to the satisfaction of the users.

BRIEF DESCRIPTION OF THE DRAWINGS

The invention will be better understood from a reading of the following description, given by way of example with reference to the illustrative diagrams which accompany it and in which.

DESCRIPTION OF PREFERRED EMBODIMENTS

Figure 1:
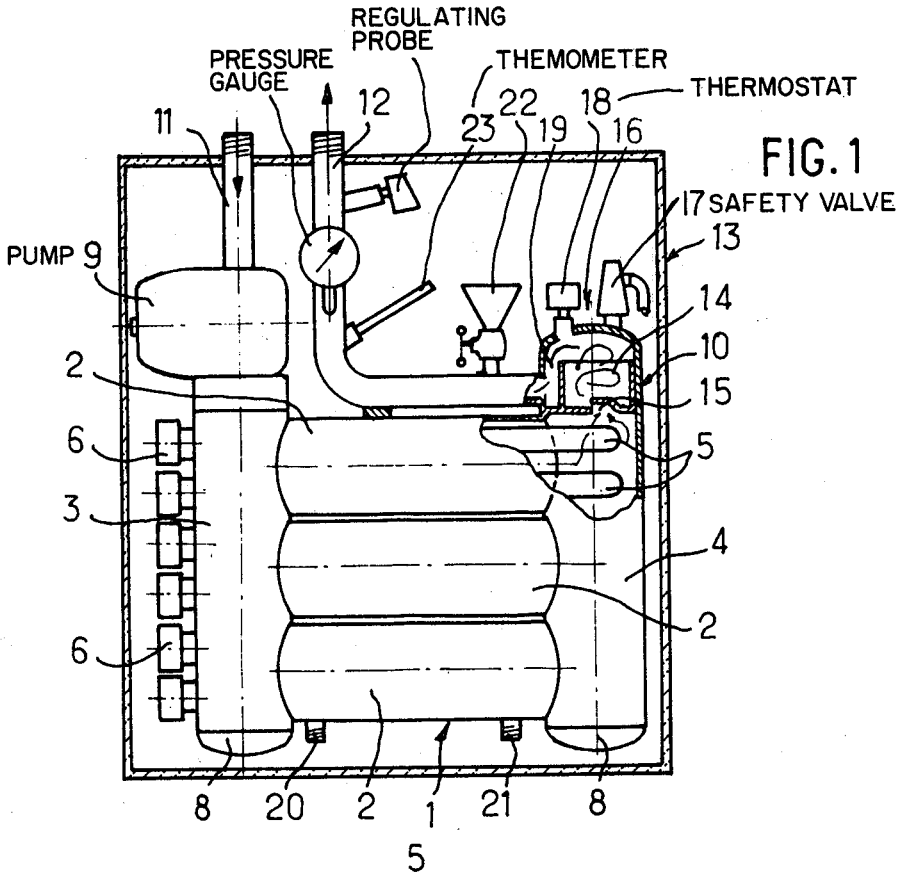
FIG. 1 is a view in elevation of the miniature furnace system in accordance with the invention, partially in section so as to diagrammatically show the turbulator.

The basic construction of the miniature furnace system in accordance with the invention will now be described. Of course different variant embodiments exist, varying particularly in the functional and technical form of the heating enclosure proper, and falling within the scope of the invention.

The miniature furnace unit in accordance with the invention will be described first of all with reference to FIG. 1.

It is formed of a heating enclosure 1 comprising a suitable number, such as two, three, four, five, six, or more than a half dozen of horizontal tubes 2 which are parallel to each other and connected together at their ends by vertical distributing tube members, referred to as upstream distributor 3 and downstream distributor 4. The entire heating enclosure is heat-insulated.

The upstream distributor 3 is a vertical tube, laterally perforated to receive electric heating resistors 5 which extend into and through the horizontal tubes, there being a suitable number of them --such as two, three, four, five, six or more than a half dozen - per tube, all completely immersed in the heat-bearing fluid on each horizontal tube. Only two resistors are in each horizontal tube, to simplify the drawings.

Each resistor is composed of an end which comprises its attachment 6 to the upstream distributor 3 and its feed, and a heating body. These resistors are distributed in such a manner that the diffusion of heat is uniform.

The distributors 3 and 4 are closed at their lower ends by caps such as 8; their body is extended upwards by circulating and homogenizing members, namely a circulating pump 9 for the upstream distributor 3 and a turbulator 10 for the downstream distributor 4, these members being fully integrated with the distributors so as to form a compact assembly which resists high pressures and in which a heat-bearing fluid, generally water, circulates. The fluid is fed from an inlet pipe 11 to an outlet pipe 12, which provide, respectively, the return and departure portions of a heating circuit; the inlet and outlet pipes are located above and perpendicular to the upper face of a covering or chest 13 containing and snugly fitting the enclosure and the parts mounted so as to facilitate connection to the base of the risers 30, 31 to be described hereinafter. The circulator 9 is a pump of conventional type whose base is fully integrated with the end of the distributor 3. The turbulator 10 makes it possible to assure substantially prefect mixing of the streams of water from horizontal tube 2 before the detection of their temperature.

The turbulator is essentially static; its internal technical construction makes it possible to produce a gyrating fluid movement for homogenizing and usually for degasification of the heat-bearing fluid.

Its structure is as follows:

The turbulator comprises essentially a cylindrical gyration chamber 14 coaxial with downstream distributor 4 and having a lower injection inlet 15, and an upper dome 16 on which the safety members are attached, namely a safety valve 17, a double function thermostat 18, usable as a temperature limiting regulating member and as a safety member and a baffle outlet 19 between the outer wall and the wall of the gyration cylinder, as shown in FIG. 1. Of course other embodiments are possible while remaining within the scope of the invention. Drain and filling branches 20 and 21 are provided on the lower side surface of the lowermost tube 2.

The outlet conduit 12 connects the outlet of the turbulator 10 with the outward distribution riser 30 of the miniature furnace system. On this conduit there are attached different control and regulating members, namely a funnel 22 for introduction of material for treatment of the heat-bearing fluid, a thermometer 23, a pressure gauge 24 and a regulating probe 25.

Figures 3, 4, 5:
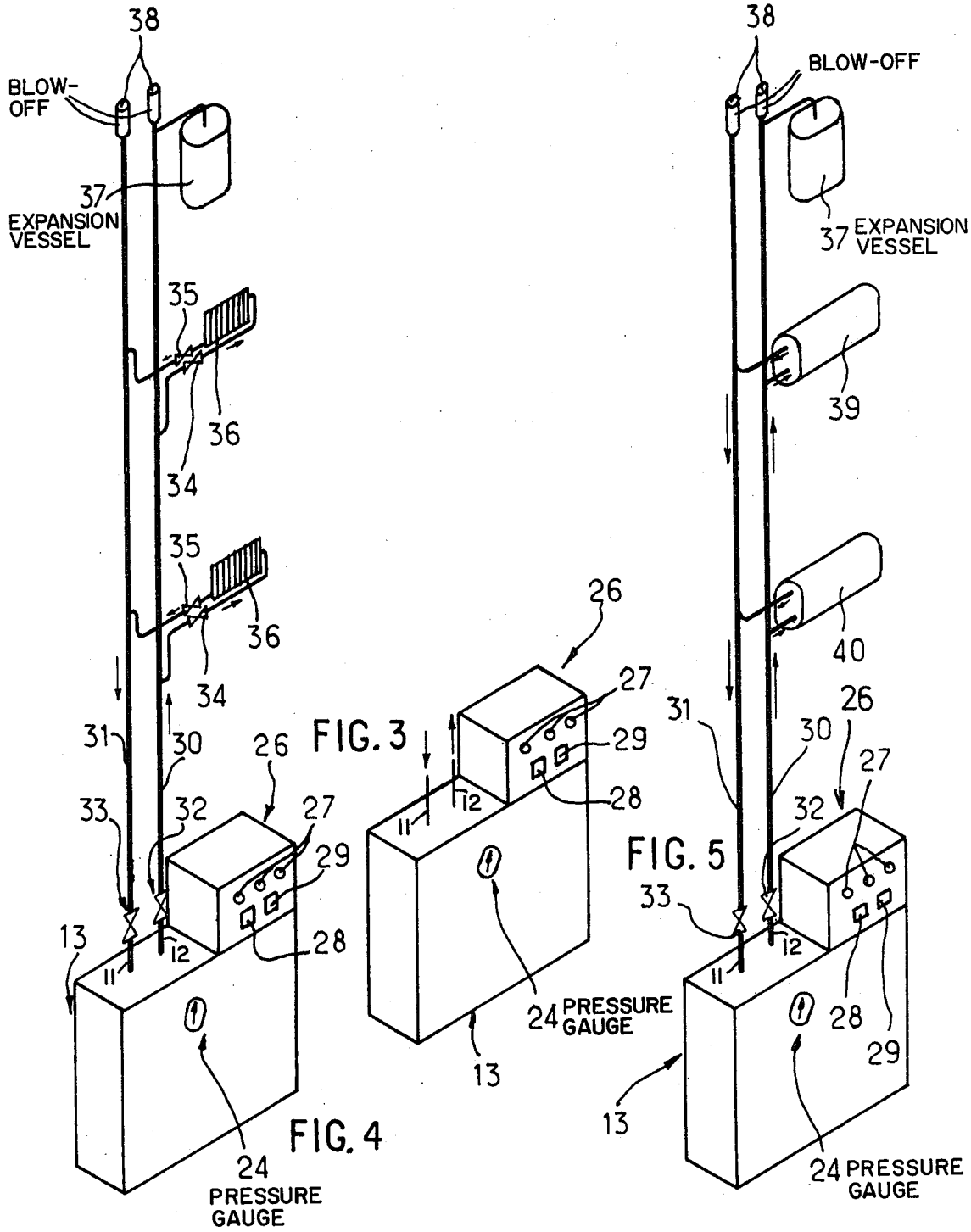
FIG. 3 is a diagrammatic view in perspective of the miniature furnace system in accordance with the invention together with its electric box.
FIG. 4 is a diagrammatic view in perspective of the system with a riser heating installation.
FIG. 5 is a similar view of an installation for the heating of water.

The chest 13 which contains the heating enclosure 1 is supplemented by an electric box 26 which is securely fastened to one of the walls of the chest (FIG. 3). This box contains the electric and electronic regulating, safety control and resistor control circuits and on its front face has various signal lights such as 27, a starting switch 28 and a stopping switch 29 and possibly other elements which indicate operation or defect.

The miniature furnace system has automatic regulation intended at all times to regulate the outlet temperatures of the heat-bearing fluid by acting via the electric box 26 either by mixing outgoing and return fluid, for instance by means of a mixer valve, not shown, or by placing the heating resistors 5 or combinations of said resistors into and out of operation one after the other, or by modulating the electric power, to thereby modulate the fluid, temperature in outlet pipe 12 as a function either of the outer climatic conditions or of the inner environmental conditions or of the heating temperature necessary for the heating of the water. The portion of the double function thermostat 18 reserved for operation as temperature limiter supplements these different regulating systems.

Furthermore, by installing a miniature furnace system at the bottom of each riser 30, 31 it becomes possible separately to regulate differently exposed zones, including for instance zones with a direct southern exposure.

As has been seen above, the main advantages of this embodiment are on the one hand its ability to resist high pressures (when the entire system is of great height) and on the other hand its direct insertion in existing installations.

These installations contain almost without exception outward and return distribution risers 30 and 31 with shut-off valves 32 and 33 and branches 34 and 35 extending towards the radiators such as 36 which are arranged on the upper floors. Of course free-air or pressure expansion vessels 37 and automatic blow-offs 38 complete the installation (FIG. 4).

Risers 30, 31 can also be connected to individual tanks such as 39,40 for the heating of water (FIG. 5).

Figure 2:
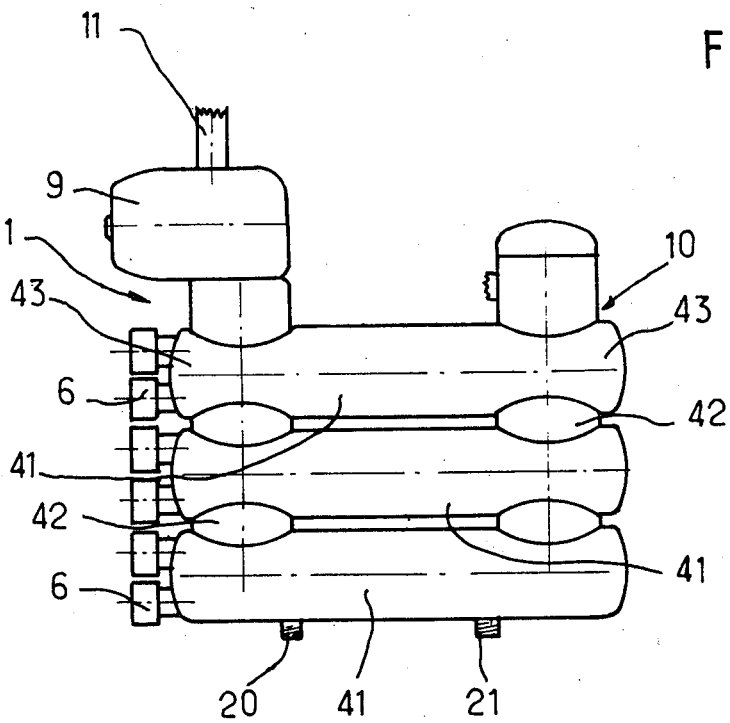
FIG. 2 is a partial view in elevation of a variant embodiment of the heating enclosure of the miniature furnace system in accordance with the invention.

A variant embodiment of the present invention is shown in FIG. 2. It uses long horizontal tubes 41 and short vertical tubes 42 between them, the horizontal tubes having relatively greater length and thus providing more complete utilization. The horizontal tube ends are closed by caps 43, those on one side bearing the attachments 6 of the electric heating resistors.

Communications between the horizontal tubes are assured by the short vertical tubes 42, the latter being coaxial on the one hand with the circulator 9 and on the other hand with the turbulator 10. This version, which is very close to the first version, also makes it possible to withstand high pressures and therefore is of advantageous use in buildings of great height.

The invention has been described in its entirety as well as two variants thereof; one can however imagine other variants which result from the first by simple modifications and which remain within the scope of the invention, particularly the shapes, dimensions and arrangements of the different parts, as well as the materials used for their manufacture, without thereby going beyond the general concept of the invention which has just been described.

I claim:

1. A compact system for central heating and water heating, comprising;

a heat-insulated water-heating enclosure shaped as a single metallic block, normally filled with heat-absorbing water and consisting of a plurality of horizontal water-heating tubes and a pair of vertical water-distributing tubes disposed at ends of the horizontal water-heating tubes and interconnecting the respective horizontal tubes in parallel flow relation, so that the shape and the size of the block correspond to the shape and size defined by the horizontal and vertical tubes and so that the water between the vertical tubes fills substantially the entire space defined by the horizontal tubes;

electric immersion heating resistors mounted to extend substantially entirely through each horizontal tube and through adjacent parts of each vertical tube and distributed over the water flow space defined thereby, for electric resistive heating of the water;

a water-circulating pump mounted directly on an upper end of one of the vertical tubes for pumping water through the horizontal tubes to be heated therein by the resistors and to be circulated for central heating and water heating, the pump having an inlet means for receiving water to be heated and outlet means communicating with the upper end of said one vertical tube through which the water to be heated is pumped into the vertical tube for distribution to the horizontal tubes; and a water-mixing device mounted directly on an upper end of the other vertical tube and housed within a vertical extension thereof for mixing portions of the water pumped through the several horizontal tubes before its being circulated for central heating and water heating, said device having an inlet communicating with the upper end of the other vertical tube for receiving the heated water therefrom, an outlet for supplying the heated water to the point of use, and means intermediate the inlet and outlet for causing mixing of the heated water.

2. A system according to claim 1 in which a half dozen of the resistors extend through each horizontal tube.

3. A system according to claim 1 including a covering containing and substantially snugly fitting the block, pump, and water-mixing device; and water outlet and return pipes extending vertically from the covering and communicatingly secured to the outlet of the water-mixing device and the inlet of the pump, respectively, for the circulating of the water.

4. A system according to claim 3 in which the water-mixing device is a tubulator comprising a water gyration chamber directly communicating with the upper end of the corresponding vertical tube, and means defining a restricted orifice between the chamber and the outlet pipe.

5. A compact furnace system for central heating and water heating, comprising: a plurality of electric immersion heating resistors; a heat-insulated water-heating enclosure normally filled with water and composed of a plurality of horizontal water heating tubes and of a pair of vertical distributing water tube members each communicating with the horizontal tubes and connecting the latter for parallel flow of water through the horizontal tubes from one vertical tube member to the other; the heating resistors being immersed and distributed in and extending through the horizontal tubes; a first one of the vertical tube members having a water-circulating pump mounted on an upper end thereof, which pump has inlet and outlet means, one of which communicates with said upper end and the other one of the vertical tube members having a water mixing device housed within a vertical extension thereof and having therein baffles to provide a turbulator which has inlet and outlet means and is similarly mounted and communicating; control and regulating means for controlling and regulating circulation of the water through the enclosure and turbulator to effect central heating and water heating by the circulated water, said means being mounted on the enclosure, pump and turbulator; and a covering containing and snugly fitting the enclosure, pump, turulator and control and regulating means.

6. A system according to claim 5 in which the control and regulating means include a safety valve and a thermostat for limiting temperature of the water heated by the resistors.

* * * * *